United States Patent [19]

Edson

[11] 4,249,337

[45] Feb. 10, 1981

[54] BREAST FEEDING DOLL SET

[76] Inventor: Theresa M. Edson, 7345 Sichting Rd., Martinsville, Ind. 46151

[21] Appl. No.: 58,398

[22] Filed: Jul. 17, 1979

[51] Int. Cl.[3] ..... A63H 3/00

[52] U.S. Cl. ..... 46/153; 46/141

[58] Field of Search ..... 46/153, 116, 141, 22, 46/151

[56] References Cited

U.S. PATENT DOCUMENTS

| | | | |
|---|---|---|---|
| 1,177,908 | 4/1916 | Teeters | 46/141 |
| 1,753,032 | 4/1930 | Stein et al. | 46/116 X |
| 3,789,547 | 2/1974 | Chemarin | 46/151 X |
| 3,987,582 | 10/1976 | Williams | 46/116 X |
| 4,197,670 | 4/1980 | Cox | 46/151 X |

FOREIGN PATENT DOCUMENTS

| | | | |
|---|---|---|---|
| 75299 | 1/1953 | Denmark | 46/141 |
| 566160 | 9/1975 | Switzerland | 46/22 |

*Primary Examiner*—F. Barry Shay

*Attorney, Agent, or Firm*—Sughrue, Rothwell, Mion, Zinn & Macpeak

[57] ABSTRACT

The mother doll is provided with fasteners on the tip of each breast and a baby doll is provided with a complimentary fastener at the mouth so that breast feeding is simulated upon joining of the fasteners. The mother doll is also provided with complimentary fasteners on the extremities of the arm to lock the arms about the baby doll to hold the baby doll against the mother doll. The fasteners may be Velcro, snaps or any other suitable device.

6 Claims, 3 Drawing Figures

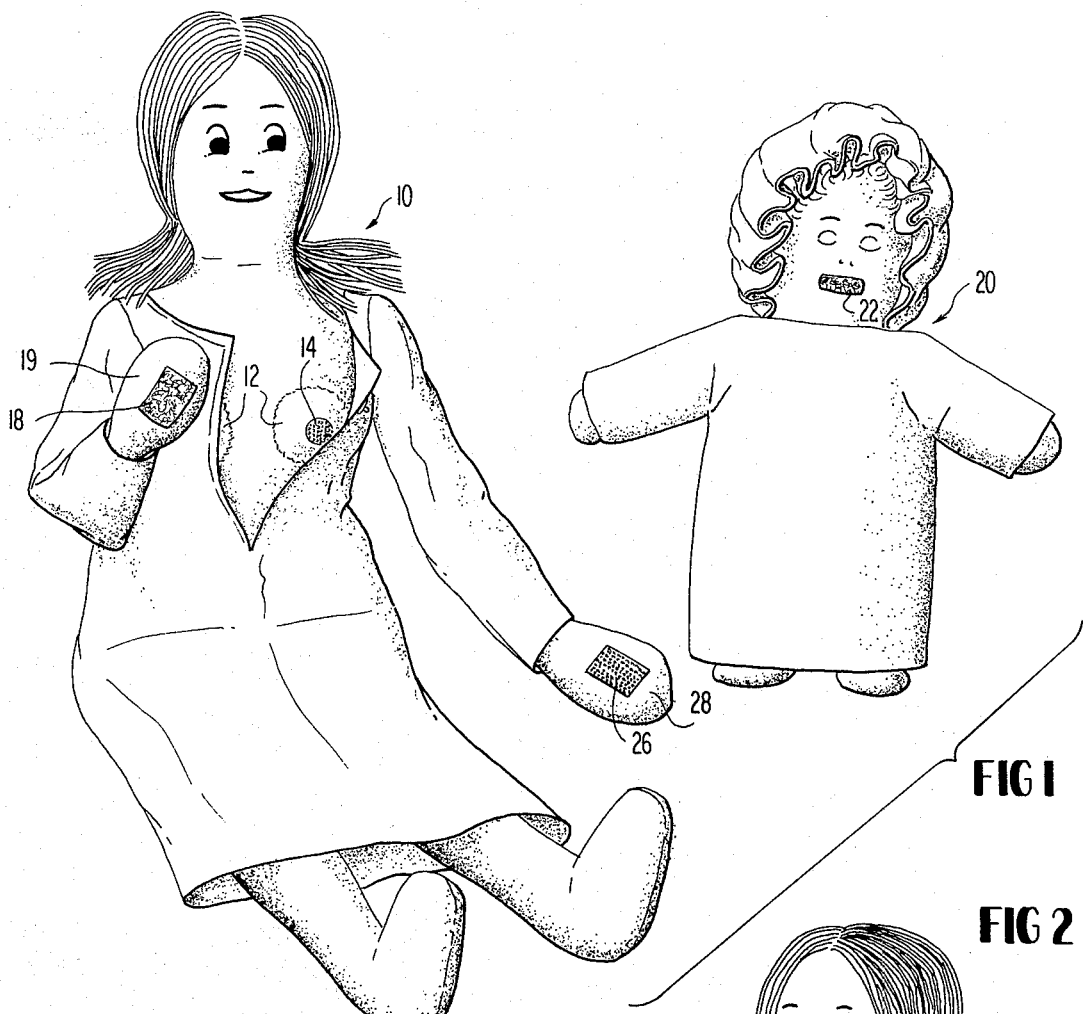
FIG 1
FIG 2
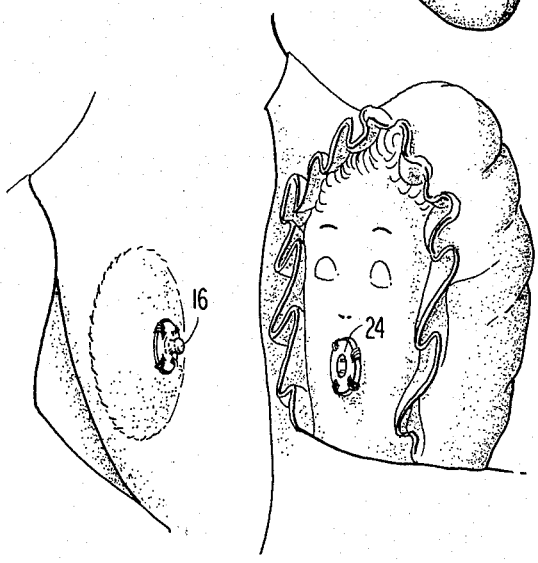
FIG 3
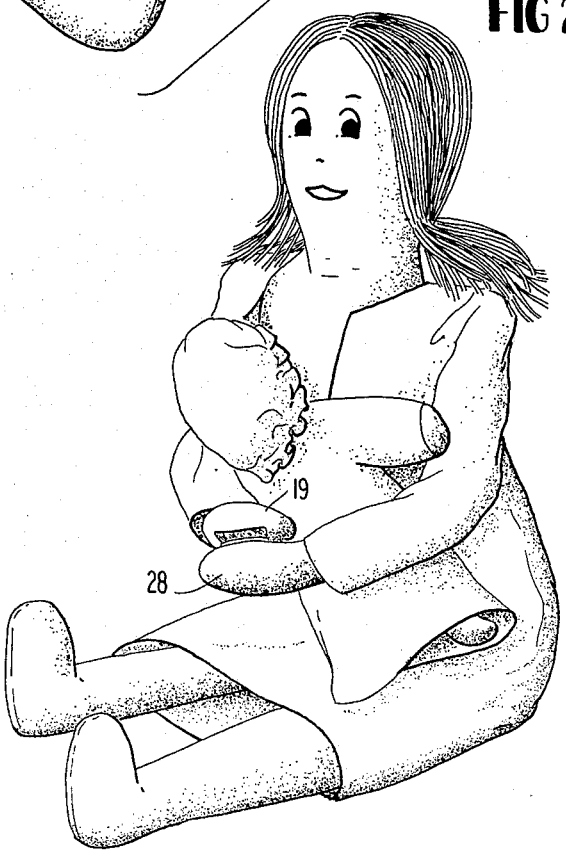

BREAST FEEDING DOLL SET

BACKGROUND OF THE INVENTION

1. Field of the Invention

The present invention is directed to dolls and more specifically to a breast feeding doll set wherein the mouth of the baby doll can be fastened to the breast of the mother doll to simulate breast feeding. Additional fasteners are provided on the arms of the mother doll to hold the baby doll in a breast feeding position.

2. Prior Art

It is old and well known in the art to produce dolls resembling a mature woman as well as to produce baby dolls. It is also old and well known to provide humanoid dolls which are capable of simulating certin human functions such as crying, taking nourishment from a bottle, wetting and the like. The U.S. Pat. No. to Thorn et al 4,074,460 is an example of such a baby doll which is capable of simulating the nursing function with respect to a bottle.

With respect to a simulated nursing operation between a mother and her young, the only known representations involve animals. The U.S. Pat. No. to Teeters 1,177,908 discloses a toy which shows a mother animal feeding her young including motor means to provide relative movement between the mother and her babies to simulate nursing. Danish Pat. No. 75,299 also discloses a toy showing a mother animal nursing her young.

Other representations of a mother nursing her young involve statues wherein the baby is being held by the mother during nursing. However, the mother and child are not separable from each other nor are statues considered to be in the same catagory as dolls.

SUMMARY OF THE INVENTION

The present invention provides a mother and child doll set wherein the dolls may be played with individually or wherein the mouth of the baby doll may be joined to the breast of the mother doll to simulate a nursing operation by any suitable fastening means. The mother doll is also provided with complimentary fastening means on the extremities of her arms so that the arms may be secured about the baby doll to hold the baby doll in a breast feeding position. The fastening means may be complimentary VELCRO strips, snap fasteners or any other suitable fastening means.

The foregoing and other objects, features and advantages of this invention will be apparent from the following more particular description of a preferred embodiment of the invention as illustrated in the accompanying drawings.

BRIEF DESCRIPTION OF THE DRAWINGS

FIG. 1 is a perspective view showing the mother doll and baby doll separated from each other.

FIG. 2 is a perspective view of the mother and child doll set with the mouth of the baby doll attached to the breast of the mother doll.

FIG. 3 shows a modification of the fastening means for securing the mouth of the baby doll to the breast of the mother doll.

DETAILED DESCRIPTION OF THE INVENTION

The breast feeding doll set according to the present invention is comprised of a mother doll 10 and a baby doll 20 which may be of any desired construction. As illustrated in the drawings by way of example the mother and baby dolls are of the stuffed cloth covered type generally known as "rag dolls". The details of the doll constructions are immaterial to the present invention with the exception of the breasts and hands of the mother doll and the mouth of the baby doll.

The mother doll 10 is provided with a pair of raised simulated breasts 12 having fasteners 14 secured to the tip of the breast at the nipple location. The fastener 14 as shown in FIG. 1 is a strip of VELCRO fastener and the complimentary strip of VELCRO fastener 22 is secured to the face of the baby doll 20 at the mouth location. It is immaterial whether the hook portion or the loop portion of the VELCRO fastener is secured to the mother doll or the baby doll. Upon pressing the VELCRO fastener 22 secured to the baby doll 20 against the VELCRO fastener 14 on the breast of the mother doll, the two will be joined together in a simulated breast feeding operation.

In the modified arrangement of FIG. 3, a male snap fastener element 16 is secured to the breast of the mother doll and a female snap fastener element 24 is secured to the face of the baby doll at the mouth location so that upon joining the two snap fasteners together, the dolls will be joined together in a simulated breast feeding operation. Although it is possible to reverse the locations of the snap fasteners 16 and 14, it is preferred to locate the male snap fastener element on the breast of the mother doll since it more closely resemble the breast nipple.

Although the baby doll is firmly secured to the mother doll by means of the complimentary fastening means it is also desirable to have the arms of the mother doll encircle the baby doll as if holding the baby doll. In order to accomplish this a first VELCRO fastener strip 18 is secured to the back of one had 19 of the mother doll and a complimentary VELCRO fastening strip 26 is secured to the front of the hand 28 of the mother doll. Thus, with the baby in the breast feeding position as shown in FIG. 2, the hands 19 and 28 of the mother doll may be overlapped behind the baby doll and joined together by means of the complimentary VELCRO fastener strips 18 and 26.

While the invention has been particularly shown and described with reference to preferred embodiments thereof, it will be understood by those in the art that the foregoing and other changes in form and details may be made therein without departing from the spirit and scope of the invention.

What is claimed is:

1. A breast feeding doll set comprising a mother doll having simulated breasts, first fastening means secured to the tip of each breast, a baby doll having a head and second fastening means secured to the head at the location of the mouth, said first and second fastening means being complimentary to each other for securing the baby doll to the mother doll in a simulated breast feeding operation and means for maintaining the arms of the mother doll in holding relation with respect to the baby doll.

2. A breast feeding doll set as set forth in claim 1, wherein one of said first and second fastening means is comprised of a fabric strip having a plurality of loops thereon and the other of said first and second fastening means is comprised of a fabric strip having a plurality of hooks thereon.

3. A breast feeding doll set as set forth in claim 1, wherein said first and second fastening means are comprised of a set of snap fasteners.

4. A breast feeding doll set as set forth in claim 1, wherein said means for maintaining comprises additional complimentary fastening means secured to the hands of the mother doll for securing the hands together behind the baby doll when the baby doll is secured to the mother doll in the simulated breast feeding position.

5. A breast feeding doll set as set forth in claim 4, wherein said additional complimentary fastening means are comprised of a fabric strip having a plurality of loops thereon and a fabric strip having a plurality of hooks thereon.

6. A breast feeding doll set as set forth in claim 4, wherein said additional complimentary fastening means is comprised of a set of snap fasteners.

* * * * *